US006624367B1

(12) United States Patent
Chen

(10) Patent No.: US 6,624,367 B1
(45) Date of Patent: Sep. 23, 2003

(54) MICROMACHINE SWITCH

(75) Inventor: Shuguang Chen, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/869,898

(22) PCT Filed: Nov. 19, 1999

(86) PCT No.: PCT/JP99/06486

§ 371 (c)(1),
(2), (4) Date: Jul. 9, 2001

(87) PCT Pub. No.: WO00/41200

PCT Pub. Date: Jul. 13, 2000

(30) Foreign Application Priority Data

Jan. 7, 1999 (JP) ..... 11-001641

(51) Int. Cl.[7] ..... H01H 57/00

(52) U.S. Cl. ..... 200/181; 200/245; 361/234; 216/13

(58) Field of Search ..... 200/181, 245, 200/246; 361/233, 234, 211, 230, 231, 232; 216/13, 99, 83

(56) References Cited

U.S. PATENT DOCUMENTS 5,258,591 A 11/1993 Buck
5,578,976 A 11/1996 Yao
5,638,946 A 6/1997 Zavracky
5,677,823 A * 10/1997 Smith ..... 361/234
6,229,683 B1 * 5/2001 Goodwin-Johansson .... 361/233
6,331,257 B1 * 12/2001 Loo et al. ..... 216/13
6,396,368 B1 * 5/2002 Chow et al. ..... 333/262

FOREIGN PATENT DOCUMENTS

JP 57-197728 12/1982
JP 3-053731 5/1991
JP 4-269416 9/1992
JP 5-002972 1/1993
JP 9-213191 8/1997

OTHER PUBLICATIONS

J. Jason Yao et al., "A Surface Micromachined Miniature Switch for Telecommunications Applications with Signal Frequencies from DC Up to 4 GHZ," International Conference on Solid–State Sensors and Actuators and Euroesensors, V. 2, 1995, pp. 384–387.

Sumit Majumder et al., "Study of Contacts in an Electrostatically Actuated Microswitch," Proceedings of the 44th IEEE Holm Conference on Electrical Contacts, 1998, pp. 127–132.

* cited by examiner

*Primary Examiner*—Elvin Enad
*Assistant Examiner*—K. Lee
(74) *Attorney, Agent, or Firm*—Young & Thompson

(57) ABSTRACT

A control line (16*a*) and control terminal (3*a*) are disposed farther away from a signal line (2*a*) than a position of an electrode (11). This reduces the loss of energy flowing in the signal line opened/closed by a micromachine switch.

17 Claims, 9 Drawing Sheets

MICROMACHINE SWITCH

TECHNICAL FIELD

The present invention relates to a micromachine switch used in a milliwave circuit and microwave circuit.

BACKGROUND ART

Switch devices such as a PIN diode switch, HEMT switch, micromachine switch, and the like are used in a milliwave circuit and microwave circuit. Of these switches, the micromachine switch is characterized in that the loss is smaller than that of the other devices, and a compact high-integrated switch can be easily realized.

As a conventional micromachine switch, for example, a switch is described in Japanese Patent Laid-Open No. 9-17300 (U.S. Pat. No. 5,578,976). FIG. 13 is a plan view showing the structure of this micromachine switch. FIG. 14 is a sectional view taken along the line XIV–XIV' of the micromachine switch shown in FIG. 13.

As shown in FIGS. 13 and 14, signal lines 102*a* and 102*b*, lower electrode 111, post 112, and control lines 116*a* and 116*b* are formed on a dielectric substrate 104. A GND plate 105 is formed on the lower surface of the dielectric substrate 104.

The signal lines 102*a* and 102*b* are disposed apart from each other at a gap G. The signal lines 102*a* and 102*b* are lines for flowing high-frequency electromagnetic energy.

The lower electrode 111 is formed apart from the signal lines 102 and 102*b* including the gap G. The lower electrode 111 has a rectangular shape as a whole.

The control lines 116*a* and 116*b* are connected to side surfaces of the lower electrode 111 on the signal line 102*a* side and on the signal line 102*b* side, respectively. The control lines 116*a* and 116*b* are parallel to the signal lines 102*a* and 102*b*, respectively. A voltage for controlling the operation of a micromachine switch 101 is selectively applied from the control lines 116*a* and 116*b* to the lower electrode 111.

The post 112*a* is formed apart from the lower electrode 111 on an extension line from the gap G to the lower electrode 111.

The base portion of an arm 113 is fixed on the upper surface of the post 112. The arm 113 extends from the upper surface of the post 112 to a portion above the gap G via a portion above the lower electrode 111. The arm 113 is made of an insulating member.

An upper electrode 114 is formed on the upper surface of the arm 113. The upper electrode 114 extends from a portion above the post 112 to a portion above the lower electrode 111. A capacitor structure is formed by the upper electrode 114 and lower electrode 111.

A contact 115 is formed on the distal end portion of the lower surface of the arm 113. The contact 115 extends from a portion above an end portion of the signal line 102*a* to a portion above an end portion of the signal line 102*b* via the gap G.

When no voltage is applied to the lower electrode 111, the contact 115 and signal lines 102*a* and 102*b* are apart from each other. Accordingly, a little high-frequency electromagnetic energy is transmitted from the signal line 102*a* to the signal line 102*b*.

On the other hand, when a voltage is applied to the lower electrode 111, an electrostatic force for attracting the upper electrode 114 to the lower electrode 111 is generated. This force makes the arm 113 curve, and the contact 115 is displaced downward. When the contact 115 is brought into contact with the signal lines 102*a* and 102*b*, the high-frequency electromagnetic energy is transmitted from the signal line 102*a* to the signal line 102*b*.

When the control lines 116*a* and 116*b* are disposed on the same side as that of the signal lines 102*a* and 102*b*, respectively, the high-frequency electromagnetic energy flowing in the signal lines 102*a* and 102*b* leaks out into the control lines 116*a* and 116*b*. That is, the conventional micromachine switch 101 has a large energy loss. An increase in frequency of the energy makes this problem conspicuous.

When the distance between the signal lines 102*a* and 102*b* and the control lines 116*a* and 116*b* increases, the coupling amount of high-frequency electromagnetic energy becomes small. To reduce the energy loss, therefore, the lower electrode 111 continuous with the control lines 116*a* and 116*b* may be apart from the signal lines 102*a* and 102*b*.

However, the distance between the lower electrode 111 and signal lines 102*a* and 102*b* cannot be made large by the following reasons.

First, a decrease in length of a portion of the arm 113 placed above a space from the upper portion of the post 112 to the lower electrode 111 requires a large voltage to drive the micromachine switch 101. Therefore, to drive the micromachine switch 101 using a low voltage of 40V or less, a distance between the post 112 and lower electrode 111 need be made long.

In addition, if the length of the portion of the arm 113 from the upper electrode 114 to the contact 115 becomes long, the weight of the contact 115 makes the arm 113 curve. Thus, since a distance between the upper electrode 114 and contact 115 cannot be set long, the distance between the lower electrode 111 and the signal lines 102*a* and 102*b* must be inevitably shortened.

The present invention has been made to solve the above problem, and has as its object to reduce the loss of energy flowing in the signal line opened/closed by the micromachine switch.

DISCLOSURE OF INVENTION

In order to achieve the above object, a micromachine switch of the present invention is characterized by comprising at least two signal lines disposed apart from each other at a gap on a substrate and each having a fixed contact, a movable contact arranged above the fixed contacts via the gap and attached to an arm to connect the signal lines to each other in a high-frequency manner by the operation of the arm, an electrode disposed apart from the gap and each of the signal lines to receive a control signal to drive the arm, and a control line for connecting the control signal from a control terminal to the electrode, wherein the control line and the control terminal are disposed farther away from each of the signal lines than a position of the electrode.

In this case, in one structure of the control line, the portion of the control line, which is connected to the electrode, is formed obliquely with respect to one of the signal lines disposed on the same side as that of the control line. Alternatively, the control line is so formed as to extend from the electrode as a start point in a direction apart from one of the signal lines disposed on the same side as that of the control line.

In another structure, the control line includes a parallel portion which has one end connected to the electrode and is formed parallel to one of the signal lines disposed on the same side as that of the control line, and an inclined portion formed obliquely with respect to the one of the signal lines disposed on the same side as that of the control line, and connected to the other end of the parallel portion. Alternatively, the control line includes a parallel portion which has one end connected to the electrode and is formed parallel to one of the signal lines disposed on the same side as that of the control line, and an inclined portion connected to the other end of the parallel portion and extending from the other end of the parallel portion as a start point in a direction apart from the one of the signal lines disposed on the same side as that of the control line.

In this case, a length of the parallel portion of the control line is preferably not more than a ⅛ wavelength of a high-frequency signal flowing the signal lines.

In still another structure, the control line is connected to one of side surfaces of the electrode, which opposes the gap.

By forming the control line as described above, as a whole, the distance between the signal line and control line becomes larger than that in a case in which the control line is formed to be parallel to the signal line. In addition, when the control line having a predetermined length is to be formed, the component of the control line parallel to the signal line is shortened. An increase in distance between the signal line and control line and a decrease in component of the control line parallel to the signal line reduce the coupling amount from the control line to the signal line, thereby reducing the loss of energy flowing in the signal line.

On the other hand, in a structure, the electrode is a lower electrode disposed on the substrate apart from the gap and the signal lines.

In another structure, the electrode is an upper electrode disposed on the arm apart from the signal lines.

In still another structure, the electrode is a lower electrode disposed on the substrate to be apart from the gap and the signal lines, and an upper electrode disposed on the arm to be apart from the signal lines.

In all structures of the electrode, the effect described above can be obtained.

In the micromachine switch described above, when the control line is connected to one of the side surfaces of the electrode, which opposes the gap, the electrode may include a lower electrode disposed on the substrate to be apart from the gap and the signal lines, the switch may further comprise a post disposed apart from the lower electrode to support the arm, and the control line may be so formed as to pass between the lower electrode and the post. This can shorten the length of the control line when the plurality of micromachine switches are controlled through one control line.

When the switch includes the upper electrode as an electrode, the arm may include an insulating member to insulate and separate the upper electrode from the movable contact. This can reduce the coupling between the signal line and control line.

In a structure, the substrate is a dielectric substrate.

In another structure, the substrate is a semiconductor substrate.

The switch may further comprise a post for supporting the arm, and the electrode may include a lower electrode disposed on the substrate and sandwiched between the gap and post.

The switch may further comprise a post for supporting the arm, and the electrode may include a lower electrode disposed on the substrate on the different side from the post via the gap.

BEST MODE OF CARRYING OUT THE INVENTION

A micromachine switch according to embodiments of the present invention will be described in detail below with reference to the accompanying drawings. A micromachine switch to be described here is a microswitch suitable for integration by a semiconductor element manufacturing process.

First Embodiment

Figure 1:
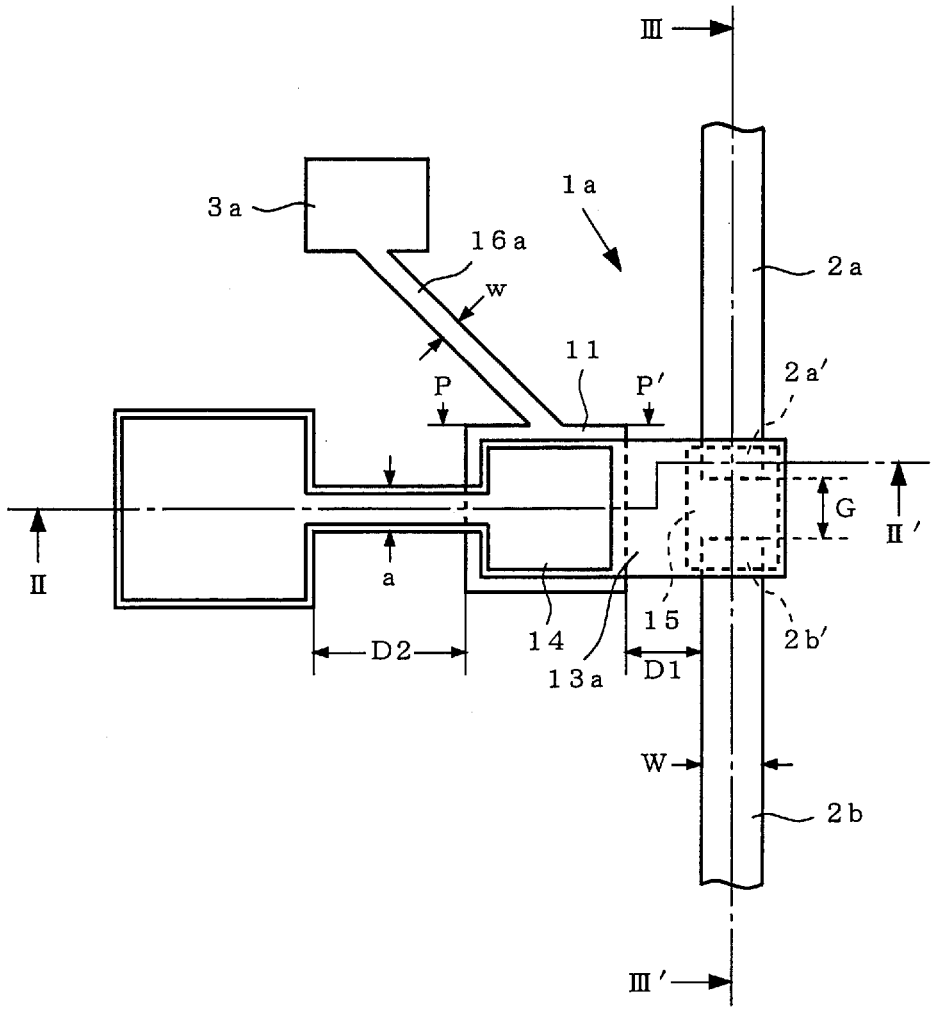
FIG. 1 is a plan view showing a structure of a micromachine switch according to the first embodiment of the present invention.
Figure 2:
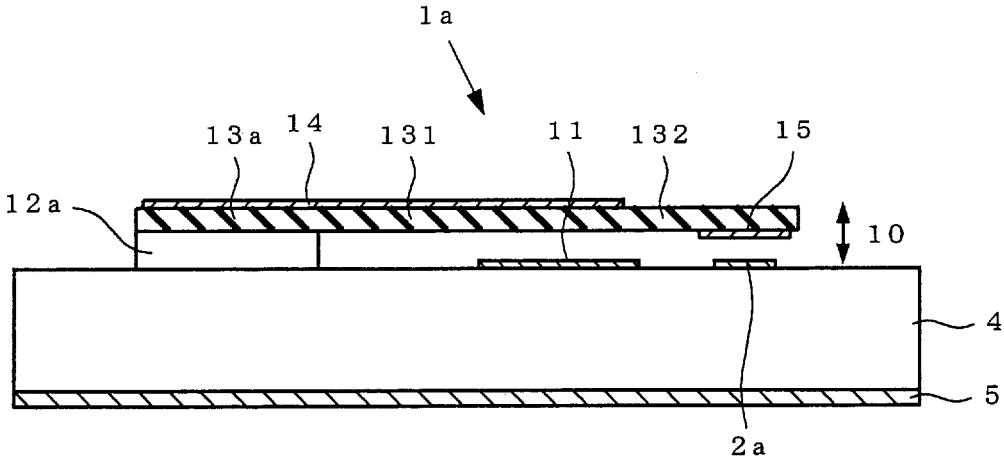
FIG. 2 is a sectional view showing a section taken along the line II–II' of the micromachine switch shown in FIG. 1.
Figure 3:
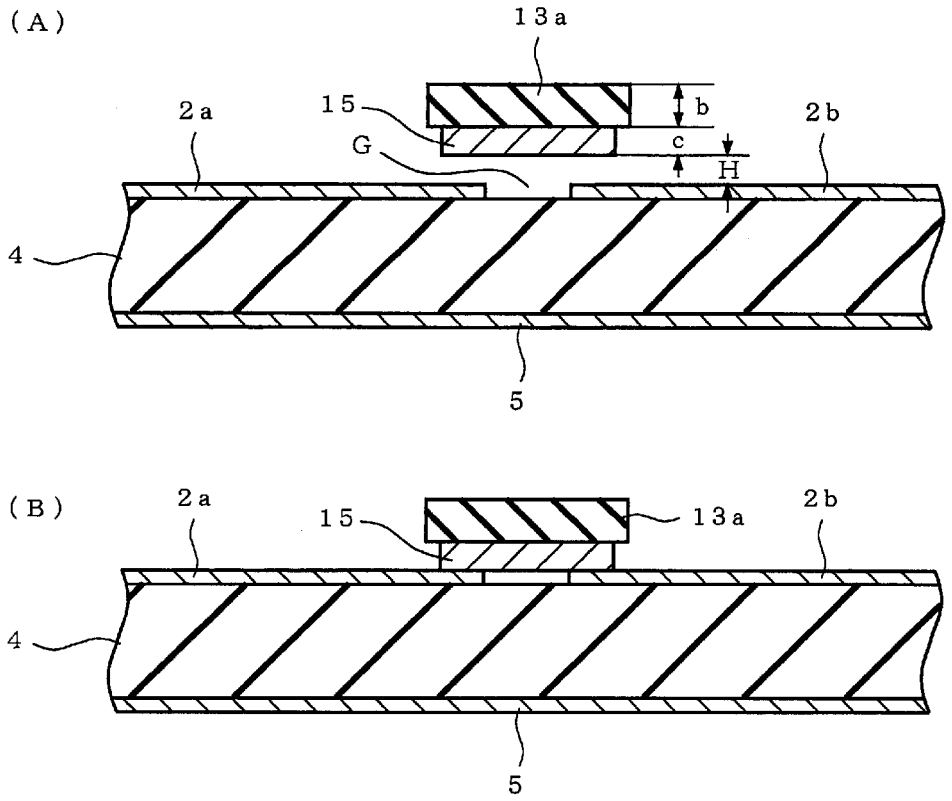
FIG. 3 shows sectional views of sections taken along the line III–III' of the micromachine switch shown in FIG. 1.

FIG. 1 is a plan view showing a structure of a micromachine switch according to the first embodiment of the present invention. FIG. 2 is a sectional view showing a section taken along the line II–II' of the micromachine switch shown in FIG. 1. FIG. 3 shows sectional views of sections taken along the line III–III' of the micromachine switch shown in FIG. 1, in which FIG. 3(*a*) shows an OFF state and FIG. 3(*b*) shows an ON state.

As shown in FIGS. 1 and 2, signal lines 2*a* and 2*b*, a lower electrode 11, a post 12*a*, a control line 16*a*, and a control terminal 3*a* are formed on a substrate 4. Of these components, each of the signal lines 2*a* and 2*b*, lower electrode 11, control line 16*a*, and control terminal 3*a* is formed by a microstrip line made of a metal which is difficult to oxidize, e.g., Au. Note that, each of the signal lines 2*a* and 2*b* or the like is formed by another type distributed constant line such as a coplanar line, triplet line, or slot line.

As the substrate 4, a dielectric substrate such as a glass substrate or a semiconductor substrate such as a Si or GaAs substrate is used. A GND plate 5 is formed on the lower surface of the substrate 4.

The signal lines 2*a* and 2*b* are apart from each other at a gap G. The signal lines 2*a* and 2*b* are lines for flowing high-frequency electromagnetic energy.

The lower electrode 11 is formed apart from the signal lines 2*a* and 2*b* at a distance D1. The lower electrode 11 is located at a position equidistant from distal end portions 2*a*' and 2*b*' of the signal lines 2*a* and 2*b*.

The lower electrode 11 has a rectangular shape as a whole. The side surface of the lower electrode on the gap G side is parallel to the signal lines 2*a* and 2*b*.

One end of the control line 16*a* is connected to the side surface of the lower electrode 11 on the signal line 2*a* side (i.e., P–P' plane). The portion of the control line 16*a*, which is connected to the lower electrode 11, is formed obliquely with respect to the signal line 2*a* disposed on the same side as that of the control line 16*a*. Note that the control line 16*a* extends from the lower electrode 11 as the start point in a direction apart from the signal line 2*a*.

The other end of the control line 16*a* is connected to the control terminal 3*a*. Therefore, the distances between the control line 16*a* and signal line 2*a* and between the control terminal 3*a* and signal line 2*a* are larger than D1.

The control terminal 3*a* selectively applies a voltage as a control signal to the lower.electrode 11 through the control line 16*a* in accordance with a control unit (not shown) for controlling the operation of a micromachine switch 1*a*.

The post 12*a* is formed on an extension line from the gap G to the lower electrode 11. The post 12*a* is apart from the lower electrode 11 at a distance D2. The post 12*a* supports an arm 13*a*, upper electrode 14, and contact 15 (to be described later). The post 12*a* may be made of an insulator, semiconductor, or conductor.

The base portion of the arm 13*a* is fixed on the upper surface of the post 12*a*. The arm 13*a* extends from the upper surface of the post 12*a* to a portion above the gap G via a portion above the lower electrode 11. The arm 13*a* is made of an insulating member, e.g., $SiO_2$.

A width of a portion 131 of the arm 13*a* placed above a space between the post 12*a* and lower electrode 11 is made narrow. As described later, the micromachine switch 1*a* is operated in the direction indicated by an arrow 10 shown in FIG. 2 by an electrostatic force generated between the upper electrode 14 and lower electrode 11 and a restoring force of the arm 13*a* represented by a spring constant. The width of the narrow portion 131 is so set as to obtain a desired spring constant.

The width of a portion 132 of the arm 13*a* placed above a space from the lower electrode 11 to gap G is made wide.

The upper electrode 14 is formed on the upper surface of the arm 13*a*. The upper electrode 14 extends, along the arm 13*a*, from a portion above the post 12*a* to a portion above the lower electrode 11. Thus, the width of a portion of the upper electrode 14 above the lower electrode 11 is made wide. The upper electrode 14 is made of metal such as Al or Au or a semiconductor such as Si.

The upper electrode 14 and lower electrode 11 sandwich the arm 13*a* therebetween and oppose each other. A capacitor structure is thus formed.

The contact 15 is further formed on the distal end portion of the lower surface of the arm 13*a*. The contact 15 extends from a portion above an end portion of the signal line 2*a* to a portion above an end portion of the signal line 2*b* via the gap G.

In an ohmic contact type micromachine switch 1*a*, the contact 15 is made of a metal which is difficult to oxidize, e.g., Au or Pt. A capacitive coupling type micromachine switch 1*a* uses the contact 15 obtained by forming an insulating thin film of $SiO_2$ or the like on the lower surface of a metal such as Au or Pt.

The ohmic contact type micromachine switch is especially appropriate to a frequency band of 10 GHz or less, and the capacitive coupling type micromachine switch is especially appropriate to a frequency band of 10 GHz or more.

When the micromachine switch 1*a* is operated in the direction of the arrow 10 shown in FIG. 2, the contact 15 connecting/disconnecting the signal lines 2*a* and 2*b* to/from each other functions as a movable contact of the switch. At this time, the distal end portions 2*a*' and 2*b*' of the signal lines 2*a* and 2*b* brought into contact with the contact 15 function as fixed contacts of the switch.

As described above, the arm 13*a* is made of the insulating member. Accordingly, the arm 13*a* insulates and separates the upper electrode 11 from contact 15, and mechanically connects them.

An example of sizes of parts of the micromachine switch 1*a* will be described here.

The distance D1 between the gap G and signal lines 2*a* and 2*b* and the lower electrode 11 is set to about 50 to 1,000 $\mu$m depending on the relationship between the weight of the contact 15 and the strength of the arm 13*a*. The distance D2 between the lower electrode 11 and post 12*a* is set to about 50 to 2,000 $\mu$m to obtain the desired spring constant of the arm 13*a*.

A width a of the narrow portion 131 of the arm 13*a* is about 20 to 1,000 $\mu$m, and a thickness b of the arm 13*a* is about 1 to 100 $\mu$m. The opposing area between the upper electrode 14 and lower electrode 11 is about 10 to 1,000,000 $\mu m^2$.

In the ohmic contact type micromachine switch, a thickness c of the contact 15 is about 1 to 10 $\mu$m. A normal height H from each of the signal lines 2*a* and 2*b* to the contact 15 is about 1 to 10 $\mu$m. The opposing area between the contact 15 and each of the signal lines 2*a* and 2*b* is about 10 to 10,000 $\mu m^2$.

In addition, a width W of each of the signal lines 2*a* and 2*b* is about 10 to 1,000 $\mu$m, and a width w of the control line 16*a* is about 5 to 1,000 $\mu$m.

The sizes described here are merely the example, and are not limited to these.

The operation of the micromachine switch 1*a* shown in FIG. 1 will be described next with reference to FIG. 3.

When the micromachine switch 1*a* is in the OFF state, and no voltage is applied to the lower electrode, as shown in FIG. 3(A), the contact 15 is placed at a height H from the signal lines 2*a* and 2*b*. At this time, a little high-frequency electromagnetic energy is transmitted from the signal line 2*a* to the signal line 2*b*.

Assume that a positive voltage is applied to the lower electrode 11. In this case, positive charges appear on the surface of the lower electrode 11. Also, negative charges appear on the lower surface of the upper electrode 11 opposing the lower electrode 11 by electrostatic induction. An electrostatic force for attracting the upper electrode 14 to the lower electrode 11 is then generated by the positive charges of the lower electrode 11 and the negative charges of the upper electrode 14.

This electrostatic force displaces the upper electrode 14 downward and makes the arm 13*a* curve, thereby also displacing the contact 15 attached to the distal end portion of the arm 13*a* downward.

As shown in FIG. 3(B), when the contact 15 is brought into contact with the distal end portions 2*a*' and 2*b*' of the signal lines 2*a* and 2*b*, the signal lines 2*a* and 2*b* are connected to each other in a high-frequency manner. This turns on the micromachine switch 1*a*. At this time, the high-frequency electromagnetic energy is transmitted from the signal line 2*a* to the signal line 2*b* with the small loss.

When stopping applying the voltage to the lower electrode again, the electrostatic force between the upper electrode 14 and lower electrode 11 disappears. This restores the arm 13*a* curving downward to the origin state, and pulls up the contact 15. At this time, since the signal lines 2*a* and 2*b* and the contact 15 are apart from each other, the micromachine switch 1*a* is turned off again.

In this manner, the voltage based on the control signal is selectively applied to the lower electrode 11 so that the contact 15 can be selectively brought into contact with the distal end portions 2*a*' and 2*b*' of the signal lines 2*a* and 2*b*, thereby controlling ON/OFF of the micromachine switch 1*a*.

As shown in FIG. 1, the control line 16*a* is formed on the same side of that of the signal line 2*a*. Thus, energy leakage from the signal line 2*a* to the control line 16*a* is not avoided.

Figure 13:
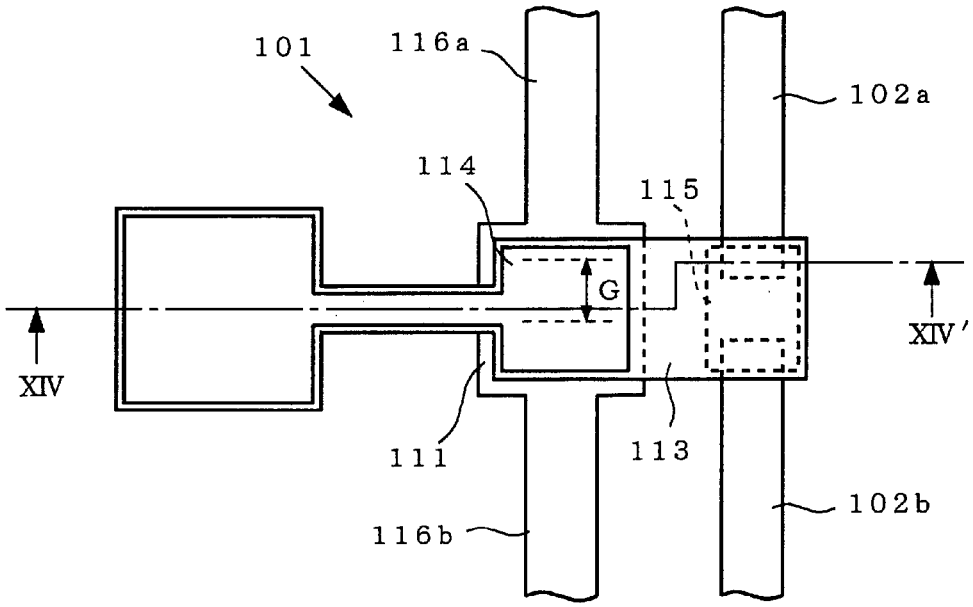
FIG. 13 a plan view showing the structure of a conventional micromachine switch.
Figure 14:
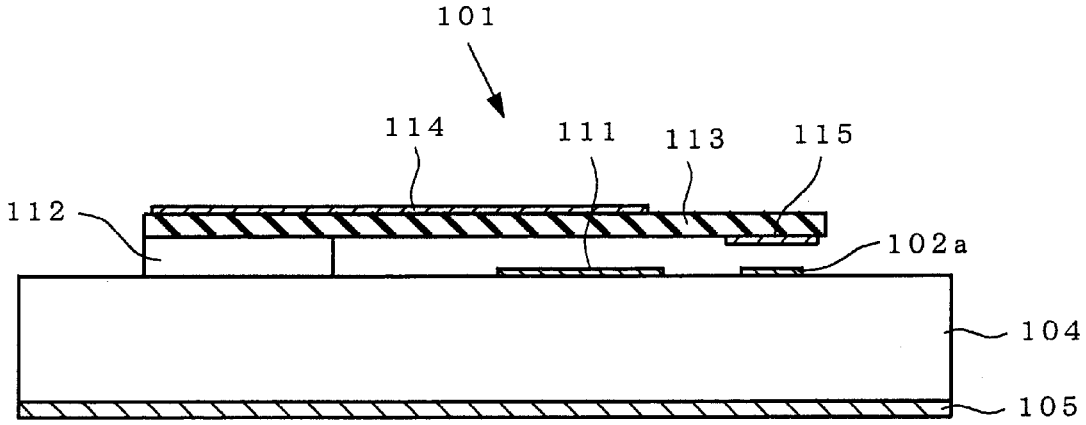
FIG. 14 is a sectional view showing a section taken along the line XIV–XIV' of the micromachine switch shown in FIG. 13.

However, the portion of the control line 16*a*, which is connected to the lower electrode 11, is formed obliquely with respect to the signal line 2*a*. With this structure, as a whole, the distance between the signal line 2*a* and control line 16*a* becomes larger than that in a case in which the control line 116 is formed to be parallel to the signal line 102*a* as shown in FIG. 13. An increase in distance between the signal line 2*a* and control line 16*a* decreases the energy leakage from the signal line 2*a* to the control line 16*a*. Accordingly, the loss of the high-frequency electromagnetic energy flowing in the signal lines 2*a* and 2*b* can be reduced by forming the control line 16*a* as shown in FIG. 1.

When the length of the control line 16*a* is previously decided in design, the component of the control line 16*a* parallel to the signal line 2*a* is shortened. A decrease in component of the control line 16*a* parallel to the signal line 2*a* reduces the energy leakage from the signal line 2*a* to the control line 16*a*. Accordingly, under the condition described above, the energy loss can be further reduced.

The micromachine switch 1*a* shown in FIG. 1 is used for, e.g., a microwave switching circuit, phase shifter, or variable filter.

Figure 4:
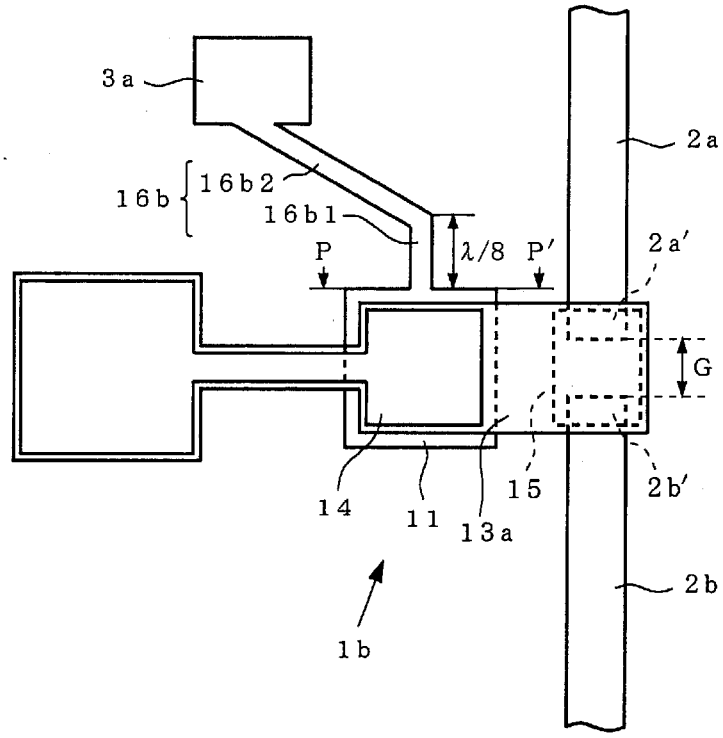
FIG. 4 is a plan view showing another structure of the micromachine switch shown in FIG. 1.

FIG. 4 is a plan view showing another structure of the micromachine switch 1*a* shown in FIG. 1. The control line 16*a* in FIG. 1 has included no portion parallel to the signal line 2*a*. In contrast to this, a control line 16*b* shown in FIG. 4 includes a parallel portion 16*b*1 parallel to the signal line 2*a* and an inclined portion 16*b*2 formed obliquely with respect to the signal line 2*a*.

One end of the parallel portion 16*b*1 is connected to the lower electrode 11 on the signal line 2*a* side (i.e., the P–P' plane), and the other end is connected to one end of the inclined portion 16*b*2. The inclined portion 16*b*2 extends from the other end of the parallel.portion 16*b*1 as the start point in a direction apart from the signal line 2*a*, and is connected to the control terminal 3*a*.

Let λ be the wavelength of a high-frequency signal flowing in the signal line 2*a*. In this case, the length of the parallel portion 16*b*1 is preferably λ/8 or less.

In this manner, since the control line 16*b* includes the portion parallel to the signal line 2*a*, the coupling amount from the signal line 2*a* to the control line 16*b* slightly increases. Since, however, the control line 16*b* includes the inclined portion 16*b*2, the energy leakage becomes smaller than that of the conventional micromachine switch 101 shown in FIG. 13.

Note that if the control line 16*b* is made narrow as needed, the coupling from the signal line 2*a* to a control line 16*d* can be reduced.

The control line 16*a* or 16*b* shown in FIG. 1 or 4 may have a portion perpendicular to the signal line 2*a*.

Figure 5:
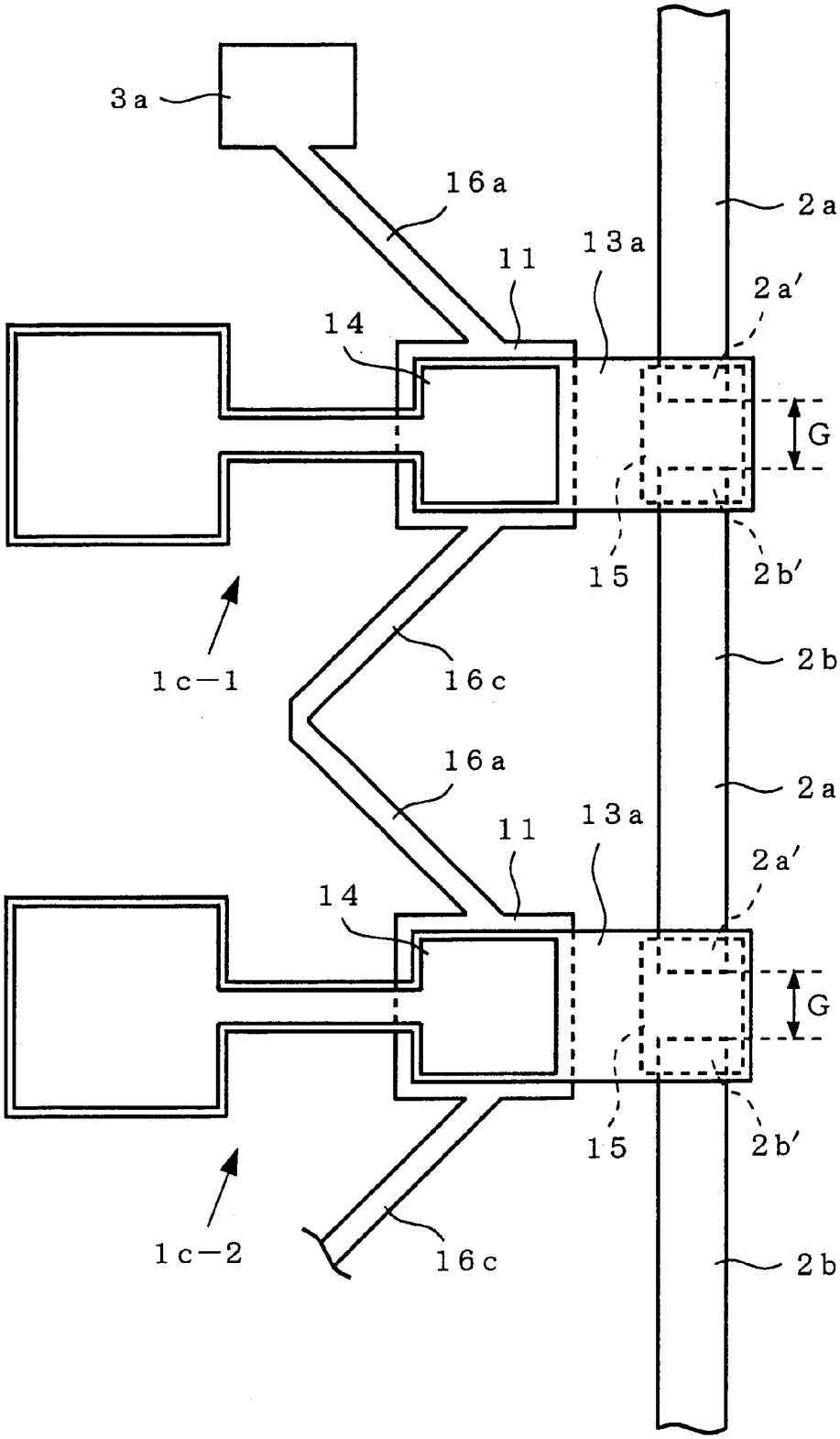
FIG. 5 is a plan view showing still another structure of the micromachine switch shown in FIG. 1.

FIG. 5 is a plan view showing still another structure of the micromachine switch 1*a* shown in FIG. 1. In the micromachine switch 1*a* shown in FIG. 1, the control line 16*a* is connected to the lower electrode 11 on only the signal line 2*a* side. As shown in FIG. 5, however, a control line 16*c* may be further connected to the lower electrode 11 on the signal line 2*b* side.

At this time, the portion of the control line 16*c*, which is connected to the lower electrode 11, is formed obliquely with respect to the signal line 2*b*. Note that the control line 16*c* extends from the lower electrode 11 as the start point in the direction apart from the signal line 2*b*.

The control line 16*a* of one micromachine switch 1*c*-1 is connected to the control terminal 3*a*. In contrast to this, the control line 16*a* of the other micromachine switch 1*c*-2 is connected to the control line 16*c* of one micromachine switch 1*c*-1. The lower electrodes 11 of the respective micromachine switches 1*c*-1 and 1*c*-2 are connected to each other in such a manner, thereby simultaneously driving the plurality of micromachine switches 1*c*-1 and 1*c*-2 through the single control terminal 3*a*.

Second Embodiment

Figure 6:
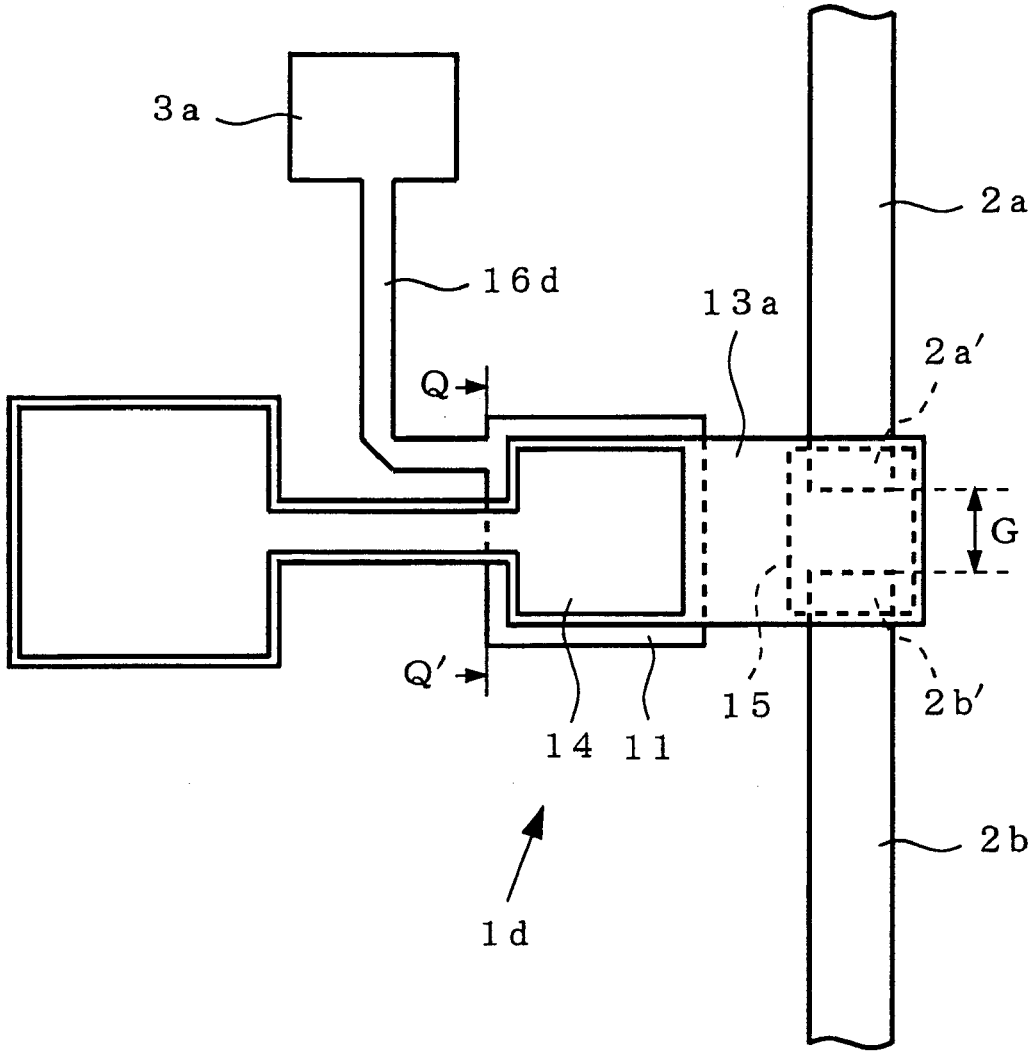
FIG. 6 is a plan view showing a structure of a micromachine switch according to the second embodiment of the present invention.

FIG. 6 is a plan view showing a structure of a micromachine switch according to the second embodiment of the present invention. In FIG. 6, the same reference numerals as in FIG. 1 denote the same or equivalent parts, and a detailed description thereof will be omitted.

As shown in FIG. 6, in a micromachine switch 1*d*, a control line 16*d* extends from as the start point one (Q–Q' plane) of the side surfaces of the lower electrode 11, which opposes a gap G, in a direction opposite to the gap G. The control line 16*d* is then bent on the signal line 2*a* side, and connected to a control terminal 3*a*.

In this manner, the distance between signal line 2*a* and control line 16*d* can be made large by connecting the control line 16*d* to one of the side surfaces of the lower electrode 11, which opposes the gap G. Therefore, the coupling amount from the signal line 2*a* to the control line 16*d* can be reduced, thereby reducing the energy loss.

Figure 7:
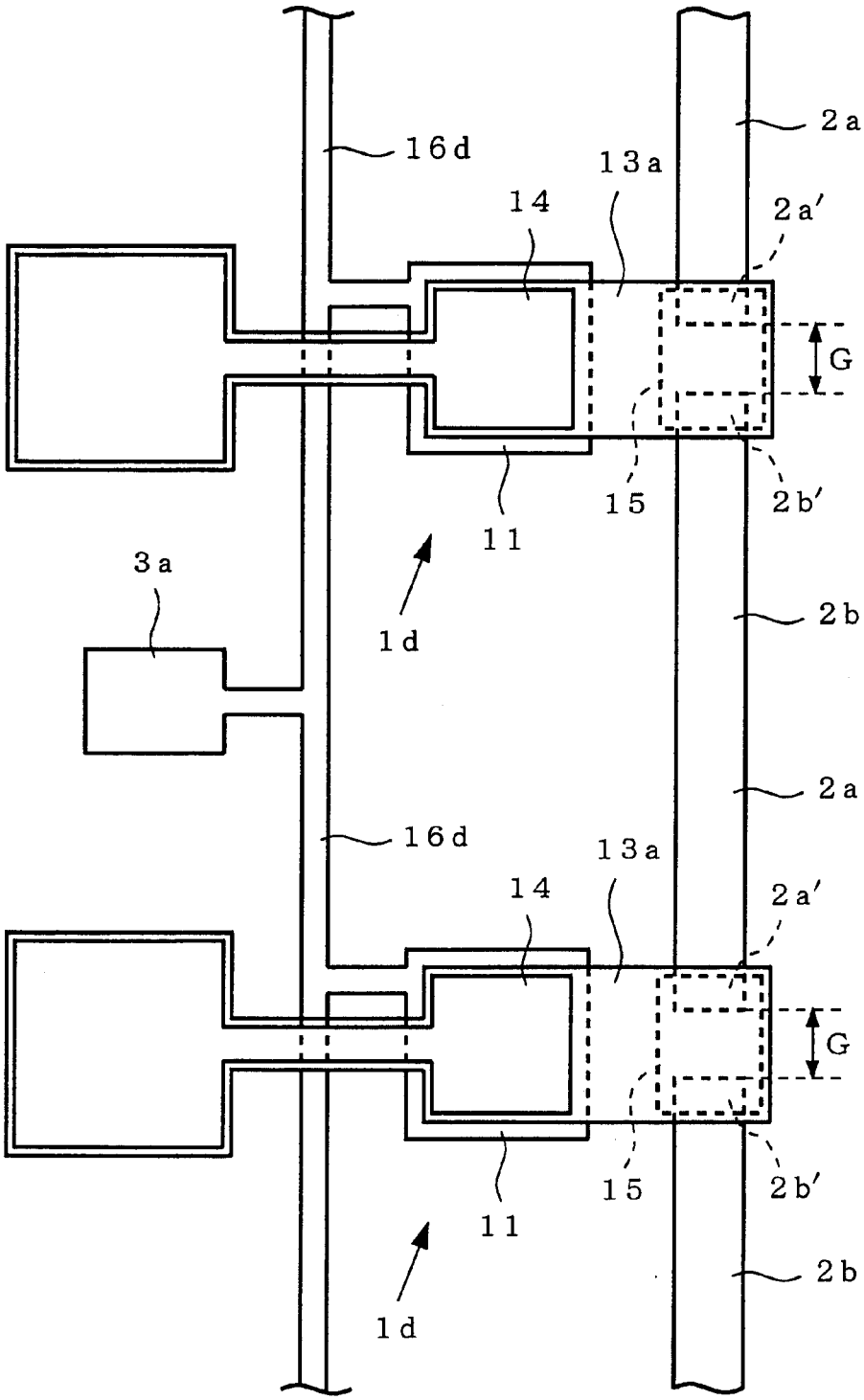
FIG. 7 is a plan view showing a modification of the micromachine switch shown in FIG. 6.

In addition, the plurality of micromachine switches 1*d* can be simultaneously driven through the single control terminal 3*a*. In this case, as shown in FIG. 7, the control line 16*d* extends through a space between the lower electrode 11 and post 12*a* below an arm 13*a* of each of the micromachine switches 1*d*. The control line 16*d* is then connected to the lower electrode 11 of each of the micromachine switches 1*d*, and connected to the single control terminal 3*a*.

In this manner, the control line 16*d* passes the space between the lower electrode 11 and the post 12*a*, thereby suppressing the energy loss and shortening the length of the control line 16*d*.

The ON insertion losses and ON coupling amounts of the conventional micromachine switch 101 shown in FIG. 13 and a micromachine switch 1*a* and the micromachine switch 1*d* respectively shown in FIGS. 1 and 6 will be described next.

Table 1 shows the calculation results of the insertion losses of the signal line 2*a*, a signal line 2*b*, a signal line 102*a*, and a signal line 102*b*, which are obtained when predetermined parameters are set. Table 2 shows the calculation results of the coupling amounts of the signal lines 2*a*, 2*b*, 102*a*, and 102*b*, which are obtained in the same setting. The calculation results shown in Tables 1 and 2 are obtained when the frequencies of high-frequency electromagnetic energy flowing in the signal lines 2*a* and 2*b* are 10 GHz, 25 GHz, and 40 GHz.

FIG. 8(A) shows the modeled conventional micromachine switch 101, FIG. 8(B) shows the modeled micromachine switch 1*a*, and FIG. 8(C) shows the modeled micromachine switch 1*d*.

In FIG. 8(A), reference numeral 102 denotes a signal line model when a contact 115 is brought into contact with the signal lines 102*a* and 102*b*. The length of the signal line model 102 is 4,000 μm; and the width, 370 μm. The distance between the signal line model 102 and a lower electrode 111 is 130 μm. The length of the lower electrode 111 is 370 μm; and the width, 1,500 μm. The length of a control line 116 is 750 μm; and the width, 200 μm.

The thickness of a dielectric substrate 104 is 200 μm; a relative dielectric constant $\epsilon$ r, 4.6; and tan $\delta$, 0.005.

Note that, letting X be the input of the signal line model 102, Y be the output of the signal line model 102, and Z be the output of control line 116.

In FIG. 8(B), a signal line model 2 corresponds to the signal line model 102, the lower electrode 11 corresponds to the lower electrode 111, the control line 16*a* corresponds to the control line 116, and a substrate 4 corresponds to the dielectric substrate 104. However, the control line 16*a* extends from one of the corners of the lower electrode 11, which is separated from the signal line model 2 and is inclined at 45° with respect to the signal line model 2.

Figure 8:
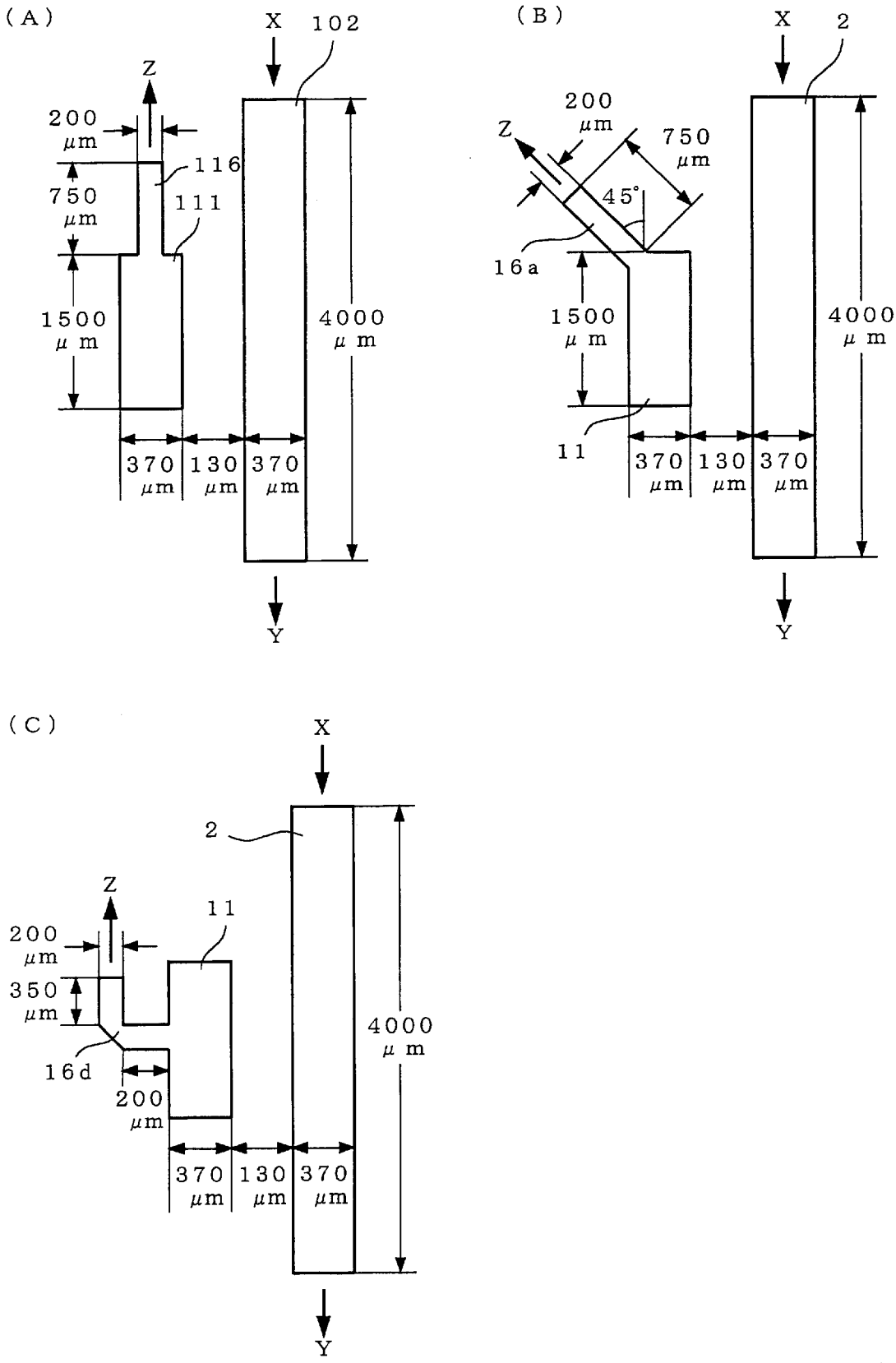
FIG. 8 shows schematic views of sizes of the micromachine switch which is modeled to calculate an insertion loss and coupling amount.

FIG. 8(C) has the same arrangement of the FIG. 8 except for the control line 16*d*. The length of the portion of the control line 16*d* perpendicular to the signal line model 2 is 200 μm; and a portion parallel to the signal line model 2, 350 μm.

TABLE 1

| Frequency | 10 GHz | 25 GHz | 40 GHz |
|---|---|---|---|
| FIG. 8(A) | −0.09 dB | −0.48 dB | −0.52 dB |
| FIG. 8(B) | −0.09 dB | −0.21 dB | −0.32 dB |
| FIG. 8(C) | −0.08 dB | −0.19 dB | −0.25 dB |

TABLE 2

| Frequency | 10 GHz | 25 GHz | 40 GHz |
|---|---|---|---|
| FIG. 8(A) | −20 dB | −13 dB | −12 dB |
| FIG. 8(B) | −22 dB | −18 dB | −16 dB |
| FIG. 8(C) | −26 dB | −18 dB | −18 dB |

The insertion loss of each of the signal lines 2*a*, 2*b*, 102*a*, and 102*b* shown in Table 1 is obtained by equation ①.

$$(\text{Insertion loss})=10\log(\text{output } Y/\text{input } X) \quad ①$$

Also, the coupling amount from the signal lines 2*a* and 2*b* or signal lines 102*a* and 102*b* to the control line 16*a* or 16*d* or control line 116 is obtained by equation ②.

$$(\text{Coupling amount})=10\log(\text{output } Z/\text{input } X) \quad ②$$

As is obvious from equation ①, an increase in value of the insertion loss reduces the energy loss. In addition, as is obvious from equation ②, a decrease in value of the coupling amount reduces the energy loss.

As shown in Table 1, the value of the insertion loss of the micromachine switch 1*a* or 1*d* modeled in FIG. 8(B) or 8(C) is generally larger than that of the conventional micromachine switch 101 modeled in FIG. 8(A). In addition, as shown in Table 2, the coupling amount of the micromachine switch 1*a* or 1*d* is generally smaller than that of the conventional micromachine switch 101. Therefore, the ON energy loss can be reduced by using the micromachine switch 1*a* or id according to the present invention.

As is also obvious from Tables 1 and 2, this effect is conspicuously exhibited as the frequency of the high-frequency electromagnetic energy flowing in the signal lines 2*a* and 2*b* increases.

The micromachine switches 1*a* to 1*d* in which a control signal is applied to the lower electrode 11 have been described above. The present invention, however, is applied to a micromachine switch in which the control signal is applied to an upper electrode 14.

Figure 9:
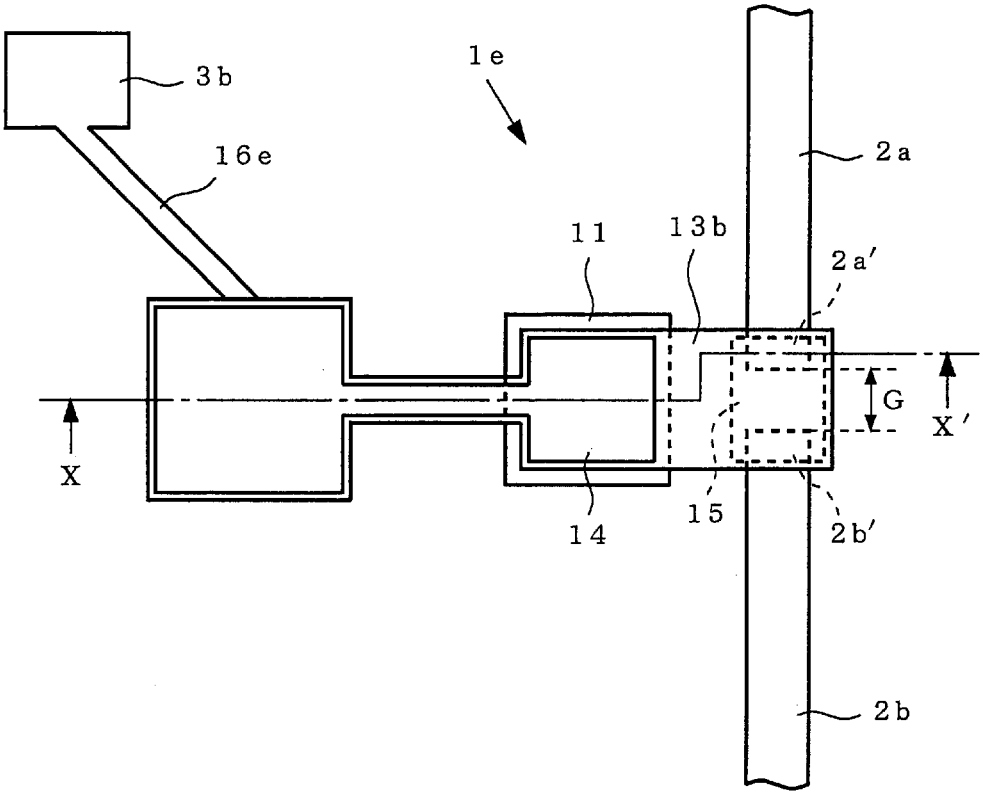
FIG. 9 is a plan view showing the structure of the micromachine switch in which a control signal is applied to an upper electrode when the present invention is applied to this micromachine switch.
Figure 10:
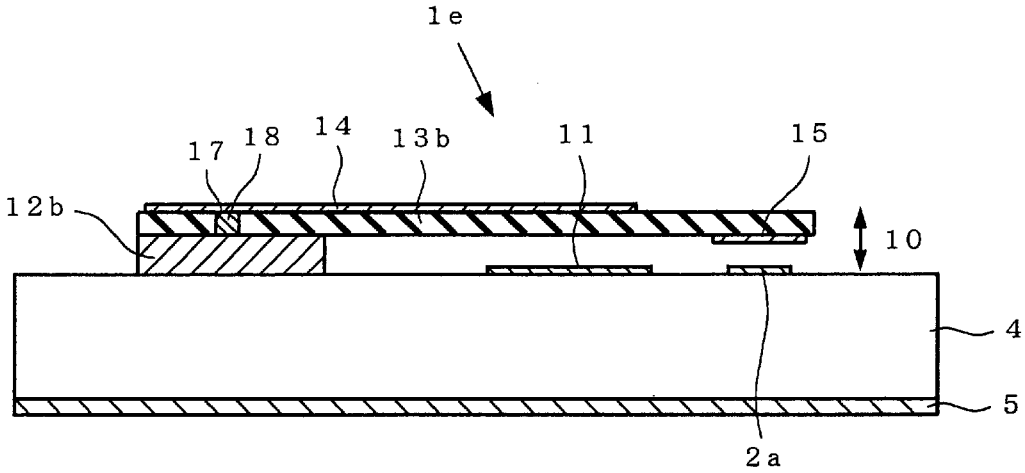
FIG. 10 is a sectional view showing a section taken along the line X–X' of the micromachine switch shown in FIG. 9.

FIG. 9 is a plan view showing the structure when the present invention is applied to a micromachine switch in which the control signal is applied to the upper electrode 14. FIG. 10 is a sectional view showing a section taken along the line X–X' of the micromachine switch shown in FIG. 9. In FIGS. 9 and 10, the same reference numerals as in FIGS. 1 and 2 denote the same or equivalent parts, and a detailed description thereof will be omitted.

In FIG. 10, a post 12*b* supporting an arm 14 and the like is made of a conductor or semiconductor. A control line 16*e* is connected to the post 12*b*. The control line 16*e* extends from the post 12*b* as the start point in a direction apart from the signal line 2*a*, and is connected to a control terminal 3*b*.

As shown in FIG. 9, the portion of the control line 16*e*, which is connected to the post 12*b*, may be formed obliquely with respect to the signal line 2*a* disposed on the same side as that of the control line 16*e*. As the control line 16*d* shown in FIG. 6, the control line 16*e* also may extend from as the start point one of the side surfaces of the post 12*b*, which opposes a gap G, in a direction opposite to the gap G.

In an arm 13*b* made of an insulating member, a contact hole 17 is formed on the upper portion of the post 12. The contact hole 17 is filled with a metal 18. The metal 18 electrically connects post 12*b* and the upper electrode 14.

Thus, a voltage is selectively applied as the control signal to the upper electrode 14 through the control line 16*e*, post 12*b*, and metal 18, thereby driving a micromachine switch 1*e*.

The micromachine switch 1*e* having such a structure can also suppress the loss of the high-frequency electromagnetic energy flowing in the signal lines 2*a* and 2*b*.

The present invention is also applied to a micromachine switch in which the control signal is applied to both the lower and upper electrodes 11 and 14.

Figure 11:
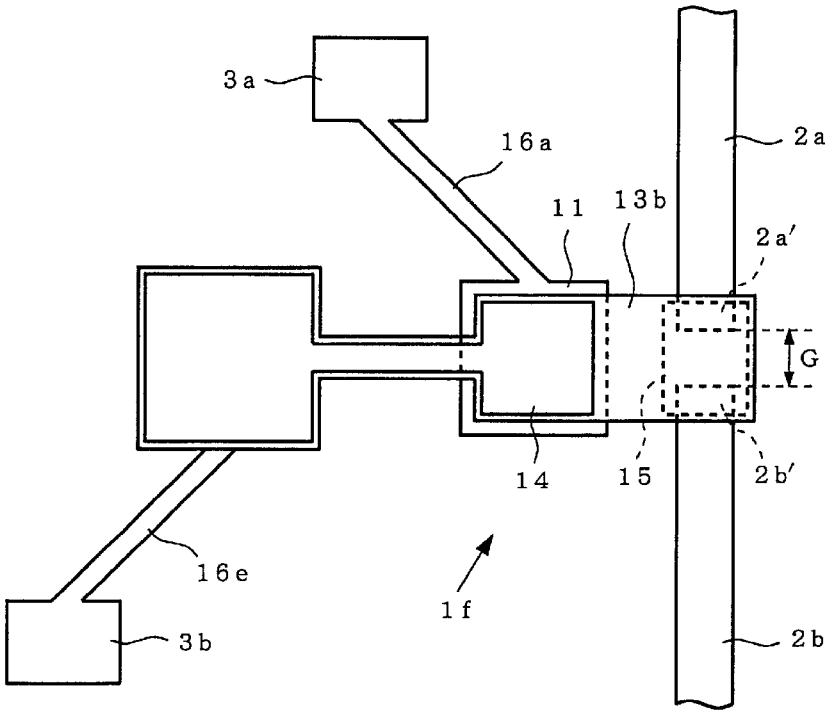
FIG. 11 is a plan view showing the structure of the micromachine switch in which a control signal is applied to both a lower electrode and the upper electrode when the present invention is applied to this micromachine switch.

FIG. 11 is a plan view showing the structure when the present invention is applied to a micromachine switch in which the control signal is applied to both the lower and upper electrodes 11 and 14. In FIG. 11, the same reference numerals as in FIGS. 1 and 9 denote the same or equivalent parts, and a detailed description thereof will be omitted.

When the control signal is applied to both the lower and upper electrodes 11 and 14, a voltage having one polarity (e.g., positive voltage) is selectively applied as the control signal to the lower electrode 11. In synchronization to this, a voltage having the other polarity (e.g., negative voltage) is selectively applied as the control signal to the upper electrode 14.

In this case, the control line 16*a* for applying the control signal to the lower electrode is called the first control line, and the control line 16*e* for applying the control signal to the upper electrode 14 is called the second control line so as to distinguish them from each other.

In addition, the present invention is applied to a micromachine switch having the post and lower electrode disposed on different sides via the signal lines 2*a* and 2*b* and gap G.

Figure 12:
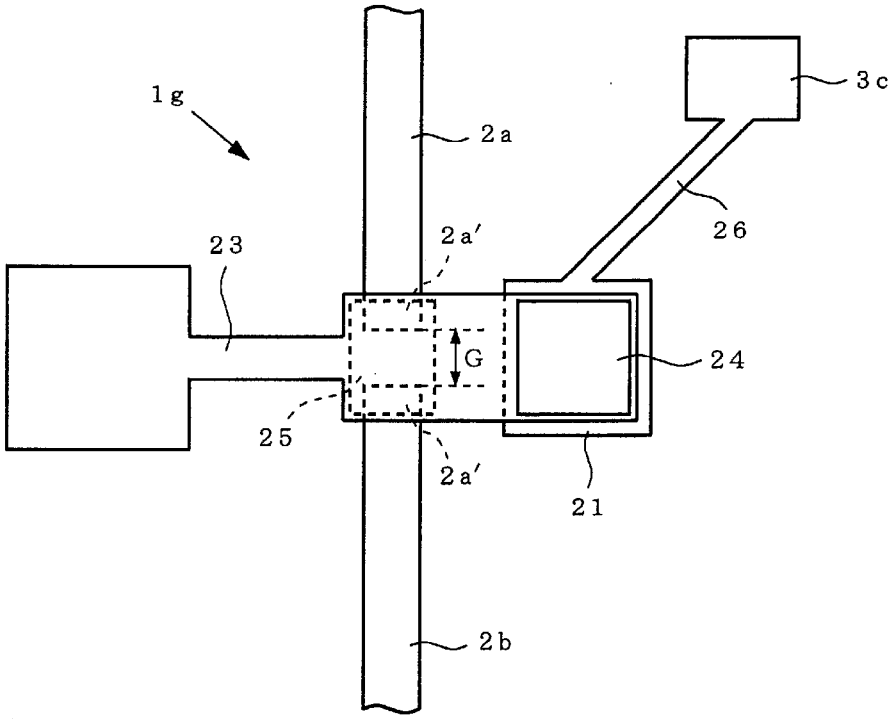
FIG. 12 is a plan view showing the structure of a micromachine switch having a post and lower electrode disposed on different sides via signal lines when the present invention is applied to this microswitch.

FIG. 12 is a plan view showing the structure when the present invention is applied to the micromachine switch of this type. An arm 23 extends from the upper surface of a post (not shown) to a portion above a lower electrode 21 through a portion above a gap G. An upper electrode 24 is formed on the distal end portion of the upper surface of the arm 23 so as to oppose the lower electrode 21. A contact 25 is formed on the lower surface of the arm 23 placed above the gap G.

A control line 26 extends from the lower electrode 21 as the start point in a direction apart from the signal line 2*a*, and is connected to a control terminal 3*c*.

In the above description, each of the micromachine switches 1*a* to 1*g* connects/disconnects two signal lines 2*a* and 2*b* to/from each other. However, the present invention is also applied to each of the micromachine switch 1*a* to 1*g* connecting/disconnecting three or more microstrip lines to/from each other.

An electromagnetic force of an electrostatic force is used to drive each of the micromachine switches 1*a* to 1*g*. The present invention, however, may be applied to micromachine switches 1*a* to 1*g* that are operated by using another electromagnetic force such as a magnetic force.

INDUSTRIAL APPLICABILITY

A micromachine switch according to the present invention is suitable for a switch device for high-frequency circuits such as a phase shifter and frequency variable filter used in a milliwave band to microwave band.

What is claimed is:

1. A micromachine switch characterized by comprising:

at least two signal lines disposed apart from each other at a gap on a substrate and each having a fixed contact;

a movable contact arranged above the fixed contacts via the gap and attached to an arm to connect said signal lines to each other in a high-frequency manner by the operation of the arm;

an electrode disposed apart from the gap and each of said signal lines to receive a control signal to drive the arm; and a control line for connecting the control signal from a control terminal to said electrode, wherein said control line and the control terminal are disposed farther away from each of said signal lines than a position of said electrode; and said control line has a portion inclined with respect to one of said signal lines arranged on the same side as that of said control line.

2. A micromachine switch according to claim 1, characterized in that the portion of said control line, which is connected to said electrode, is formed obliquely with respect to one of said signal lines disposed on the same side as that of said control line.

3. A micromachine switch according to claim 1, characterized in that said control line extends from said electrode as a start point in a direction apart from one of said signal lines disposed on the same side as that of said control line.

4. A micromachine switch according to claim 1, characterized in that said control line includes a parallel portion which has one end connected to said electrode and is formed parallel to one of said signal lines disposed on the same side as that of said control line, and an inclined portion formed obliquely with respect to the one of said signal lines disposed on the same side as that of said control line, and connected to the other end of the parallel portion.

5. A micromachine switch according to claim 4, characterized in that a length of the parallel portion of said control line is not more than a ⅛ wavelength of a high-frequency signal flowing said signal lines.

6. A micromachine switch according to claim 1, characterized in that said control line includes a parallel portion which has one end connected to said electrode and is formed parallel to one of said signal lines disposed on the same side as that of said control line, and an inclined portion connected to the other end of the parallel portion and extending from the other end of the parallel portion as a start point in a direction apart from the one of said signal lines disposed on the same side as that of said control line.

7. A micromachine switch according to claim 1, characterized in that said control line is connected to one of side surfaces of said electrode, which opposes the gap.

8. A micromachine switch according to claim 1, characterized in that said electrode is a lower electrode disposed on the substrate apart from the gap and said signal lines.

9. A micromachine switch according to claim 1, characterized in that said electrode is an upper electrode disposed on the arm apart from said signal lines.

10. A micromachine switch according to claim 1, characterized in that said electrode is a lower electrode disposed on the substrate to be apart from the gap and said signal lines, and an upper electrode disposed on the arm to be apart from said signal lines.

11. A micromachine switch according to claim 7, characterized in that said electrode includes a lower electrode disposed on the substrate to be apart from the gap and said signal lines, said switch further comprises a post disposed apart from the lower electrode to support the arm, and said control line passes between the lower electrode and said post.

12. A micromachine switch according to claim 9, characterized in that the arm includes an insulating member to insulate and separate the upper electrode from said movable contact.

13. A micromachine switch according to claim 10, characterized in that the arm includes an insulating member to insulate and separate the upper electrode from said movable contact.

14. A micromachine switch according to claim 1, characterized in that the substrate is a dielectric substrate.

15. A micromachine switch according to claim 1, characterized in that the substrate is a semiconductor substrate.

16. A micromachine switch according to claim 1, characterized in that said switch comprises a post for supporting the arm, and said electrode includes a lower electrode disposed on the substrate and sandwiched between the gap and post.

17. A micromachine switch according to claim 1, characterized in that said switch comprises a post for supporting the arm, and said electrode includes a lower electrode disposed on the substrate on the different side from the post via the gap.

* * * * *